US011851910B2

(12) United States Patent
Lin

(10) Patent No.: US 11,851,910 B2
(45) Date of Patent: Dec. 26, 2023

(54) LOCK

(71) Applicant: LINTEX CO., LTD., Zhanghua County (TW)

(72) Inventor: Chia-Sheng Lin, Zhanghua County (TW)

(73) Assignee: LINTEX CO., LTD., Zhanghua County (TW)

( * ) Notice: Subject to any disclaimer, the term of this patent is extended or adjusted under 35 U.S.C. 154(b) by 557 days.

(21) Appl. No.: 17/105,160

(22) Filed: Nov. 25, 2020

(65) Prior Publication Data

US 2021/0164262 A1 Jun. 3, 2021

(30) Foreign Application Priority Data

Dec. 2, 2019 (TW) ..... 108216045

(51) Int. Cl.
*E05B 37/02* (2006.01)
*E05B 47/06* (2006.01)

(52) U.S. Cl.
CPC ..... *E05B 37/02* (2013.01); *E05B 47/0688* (2013.01)

(58) Field of Classification Search
CPC ..... E05B 37/02; E05B 47/0688; Y10T 70/40; Y10T 70/417; Y10T 70/411; Y10T 70/443; Y10T 70/50; Y10T 70/5009; Y10T 70/5013
USPC ..... 70/22, 14, 19, 34, 57, 58, 59
See application file for complete search history.

(56) References Cited

U.S. PATENT DOCUMENTS

| | | | | |
|---|---|---|---|---|
| 864,395 | A * | 8/1907 | Tobias | E05B 37/02 70/325 |
| 3,107,934 | A * | 10/1963 | Lee | E05C 19/163 292/150 |
| 7,444,844 | B1 * | 11/2008 | Lee | E05B 37/02 70/284 |
| 2006/0248930 | A1 * | 11/2006 | Elles | E05B 37/02 70/71 |
| 2023/0135591 | A1 * | 5/2023 | Yang | E05B 73/0082 70/51 |

FOREIGN PATENT DOCUMENTS

| | | | | |
|---|---|---|---|---|
| CN | 114135169 A * | 3/2022 | | E05B 37/0031 |
| KR | 101802109 B1 * | 11/2017 | | |

* cited by examiner

*Primary Examiner* — Suzanne L Barrett
(74) *Attorney, Agent, or Firm* — Muncy, Geissler, Olds & Lowe, P.C.

(57) ABSTRACT

A lock is provided, including: a housing; a latch member, movably mounted to the housing and including a first blocking portion; a blocking member, movably mounted to the housing and including a second blocking portion; a locking member, operably mounted to the housing; wherein when the locking member is in a locking state and the latch member is in a first position, the locking member and the blocking member are free of blocking from each other so that the first blocking portion and the second blocking portion are blocked with each other, and the latch member is unmovable toward a second position; when the locking member is in a unlocked state, the second blocking portion and the first blocking portion are unblocked with each other and the latch member is movable to the second position so that the latch member is retractable from a locked object.

9 Claims, 8 Drawing Sheets

LOCK

BACKGROUND OF THE INVENTION

Field of the Invention

The present invention relates to a lock.

Description of the Prior Art

Generally, to hold a door of a building or outdoor fences, a latch which is mounted to the door plank is moved to be inserted into a hole of a door frame so that the door plank cannot be arbitrarily moved. When the door plank needs to be locked, an additional locking member needs to be provided to limit and constrain the latch to prevent the latch from sliding arbitrarily to unlock the door plank. However, the additional locking member is troublesome to use and needs to be locked by another locking member. Moreover, there is a problem of storing the another locking member which is unlocked, and the another locking member is easily lost.

The present invention is, therefore, arisen to obviate or at least mitigate the above-mentioned disadvantages.

SUMMARY OF THE INVENTION

The main object of the present invention is to provide a lock which has a simple structure and is convenient to operate.

To achieve the above and other objects, a lock is provided, including: a housing; a latch member, mounted to the housing and being movable between a first position and a second position relative to the housing, the latch member including a first blocking portion; a blocking member, mounted to the housing and being movable between a third position and a fourth position, including a second blocking portion, the blocking member having a tendency to move toward the third position; a locking member, mounted to the housing and being operable to be in a locking state or an unlocked state; wherein when the locking member is in the locking state and the latch member is located in the first position, the latch member is protrusive to be configured to be inserted within a locked object, the locking member and the blocking member are free of blocking from each other so that the blocking member is moved to the third position, the first blocking portion and the second blocking portion are blocked with each other, and the latch member is unmovable toward the second position; when the locking member is in the unlocked state, the locking member urges the blocking member to move to the fourth position, the second blocking portion and the first blocking portion are unblocked with each other and the latch member is movable to the second position so that the latch member is retractable from the locked object.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
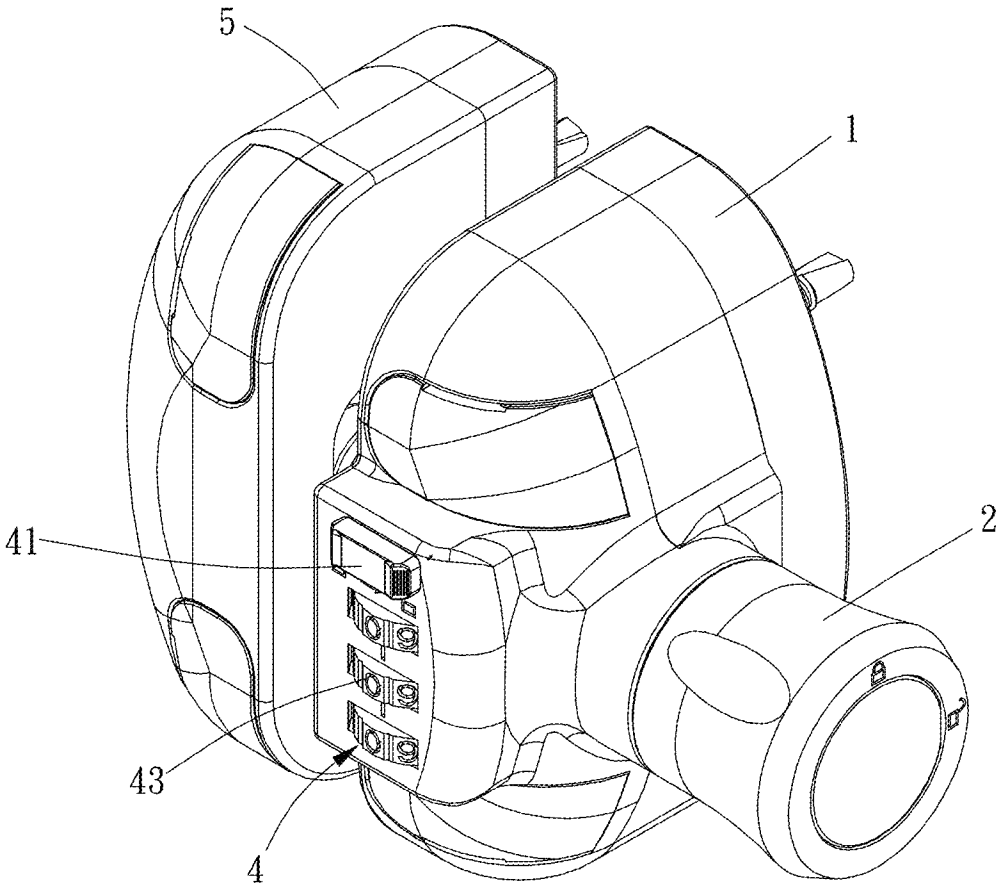
FIG. 1 is a stereogram of a preferable embodiment of the present invention.
Figure 2:
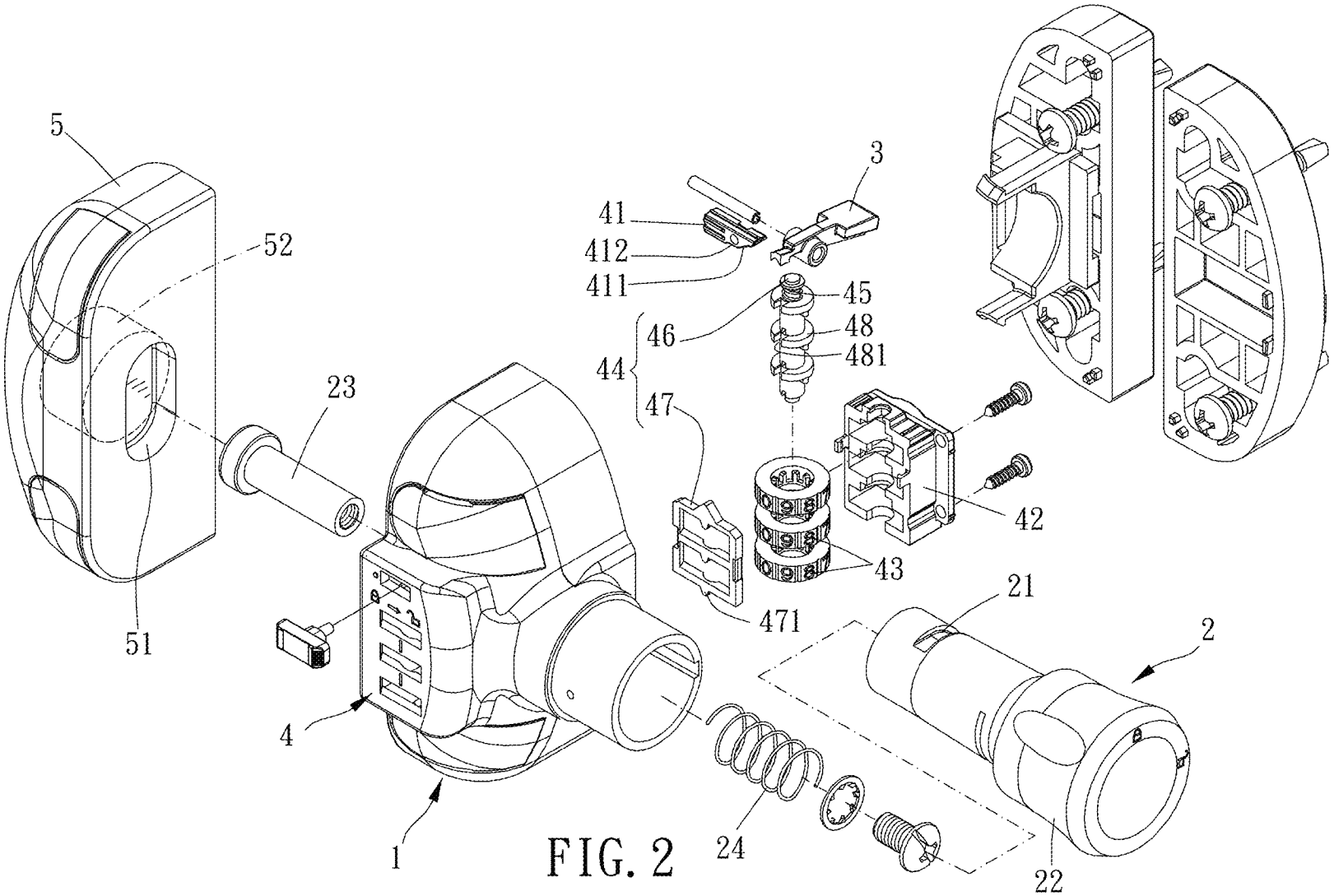
FIG. 2 is a breakdown drawing of a preferable embodiment of the present invention.
Figure 3:
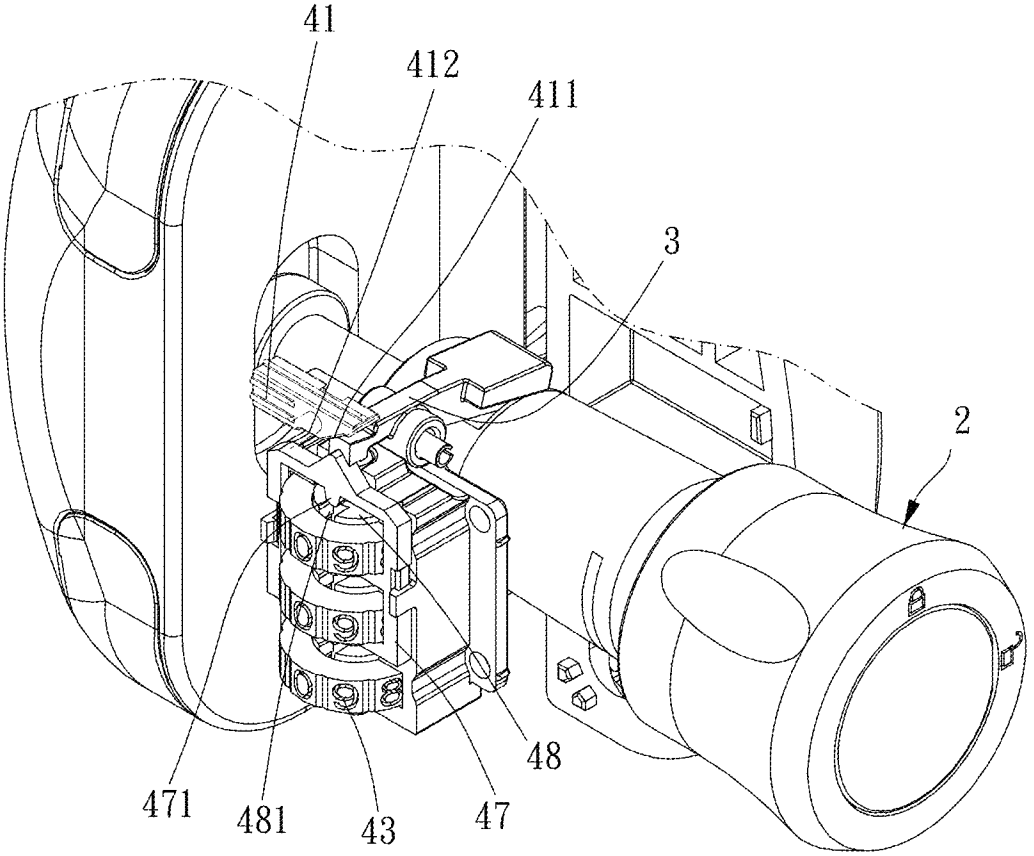
FIG. 3 is a partial perspective view of a preferable embodiment of the present invention.
Figure 4:
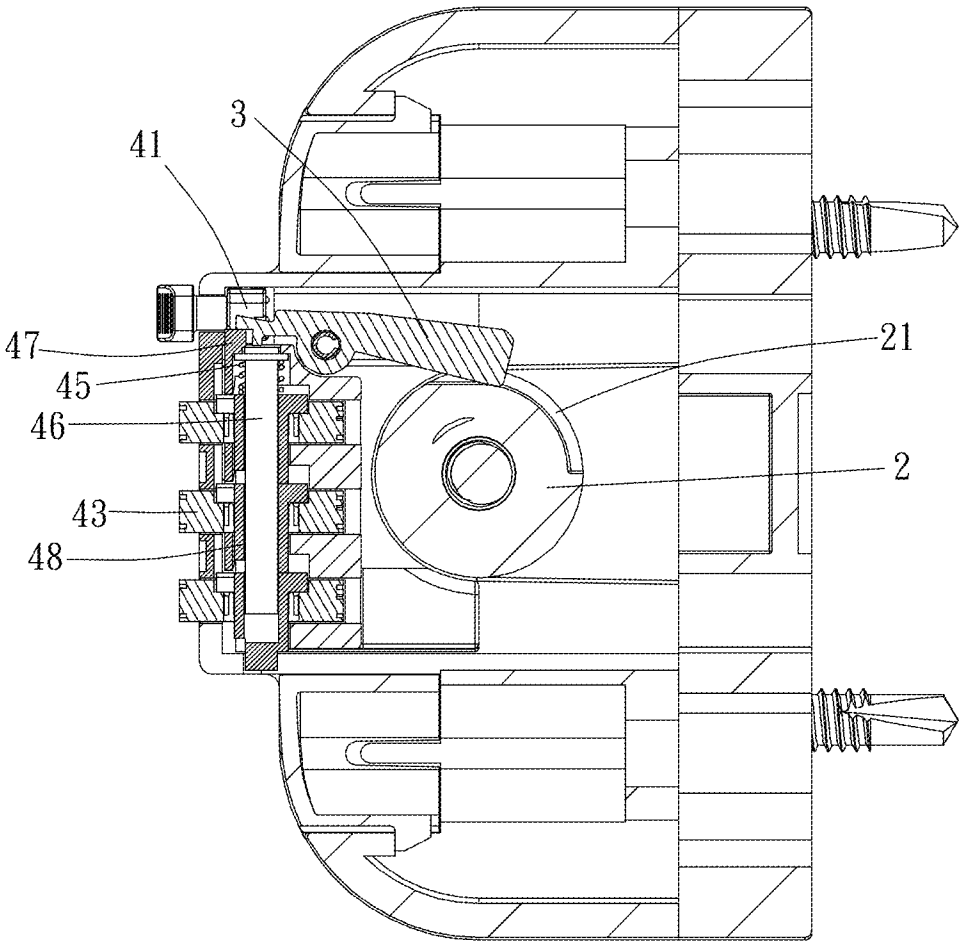
FIG. 4 is a side cross-sectional view of a preferable embodiment of the present invention.

Please refer to FIGS. 1 to 10 for a preferable embodiment of the present invention. A lock of the present invention includes a housing 1, a latch member 2, a blocking member 3 and a locking member 4.

The latch member 2 is mounted to the housing 1 and movable between a first position and a second position relative to the housing 1, and the latch member 2 includes a first blocking portion 21.

The blocking member 3 is mounted to the housing 1 and movable between a third position and a fourth position, the blocking member 3 further includes a second blocking portion, and the blocking member 3 has a tendency to move toward the third position.

The locking member 4 is mounted to the housing 1 and is operable to be in a locking state or an unlocked state.

Figure 6:
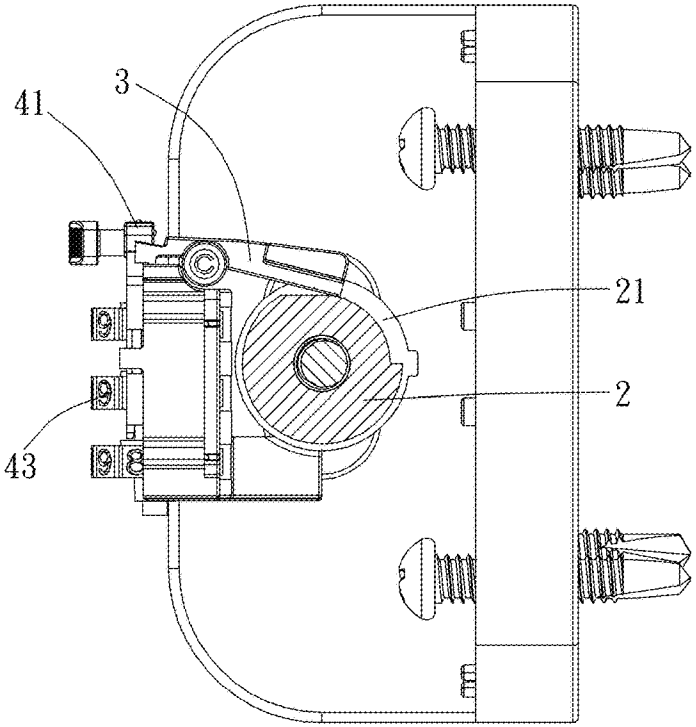
FIGS. 5 to 8 are cross-sectional views showing functional actions of a preferable embodiment of the present invention.
Figure 5:
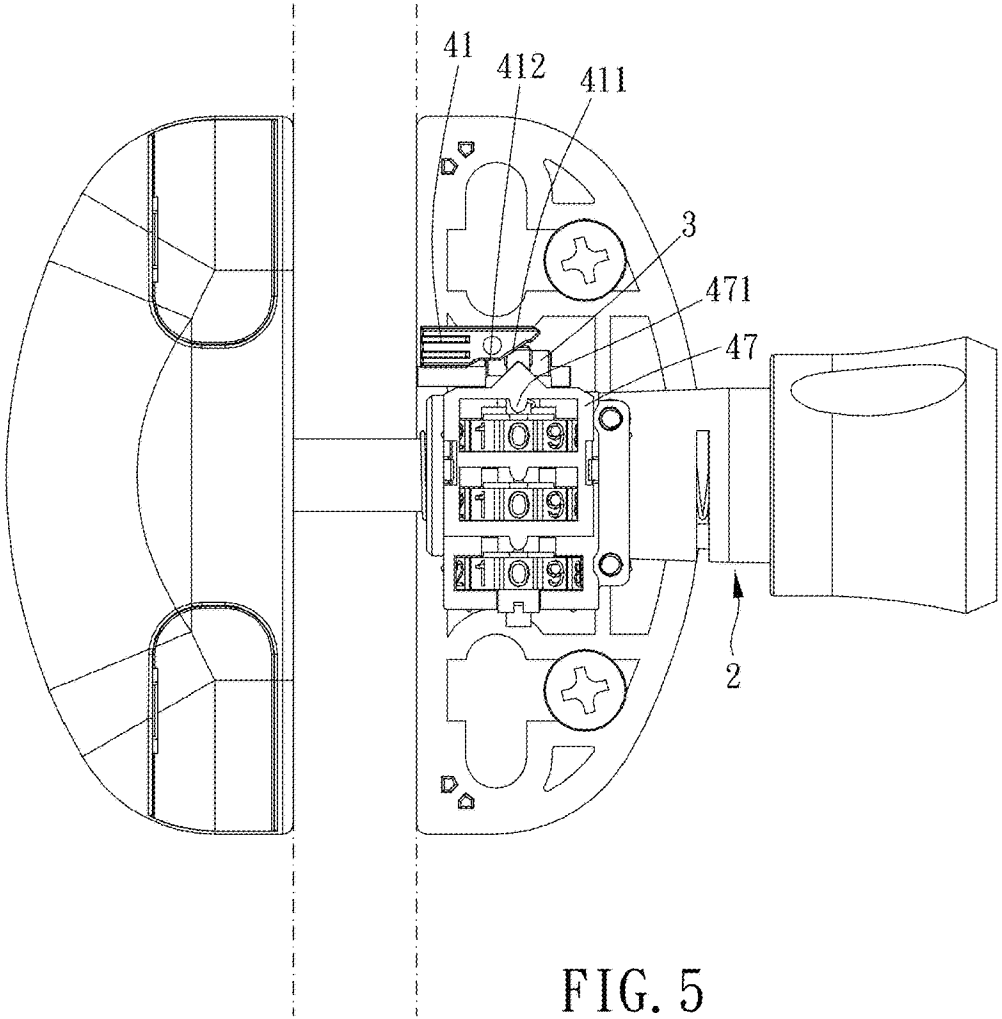
Figure 8:
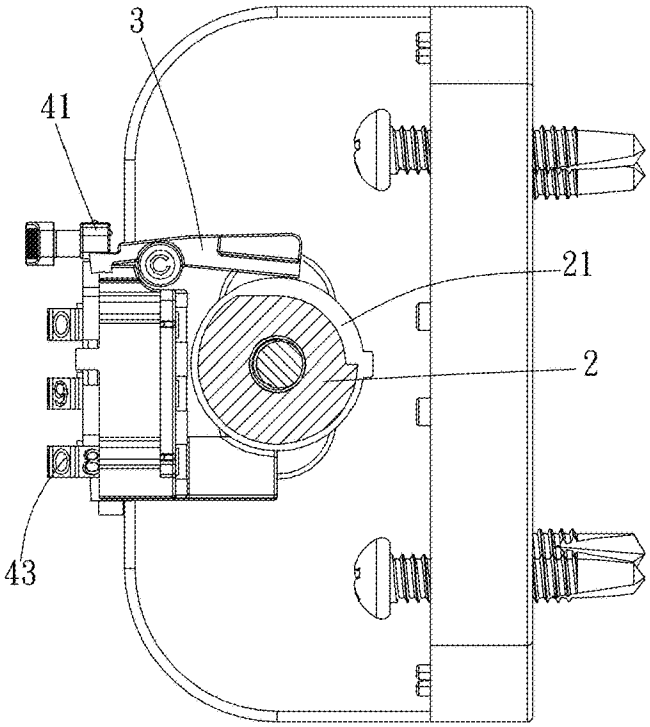
Figure 7:
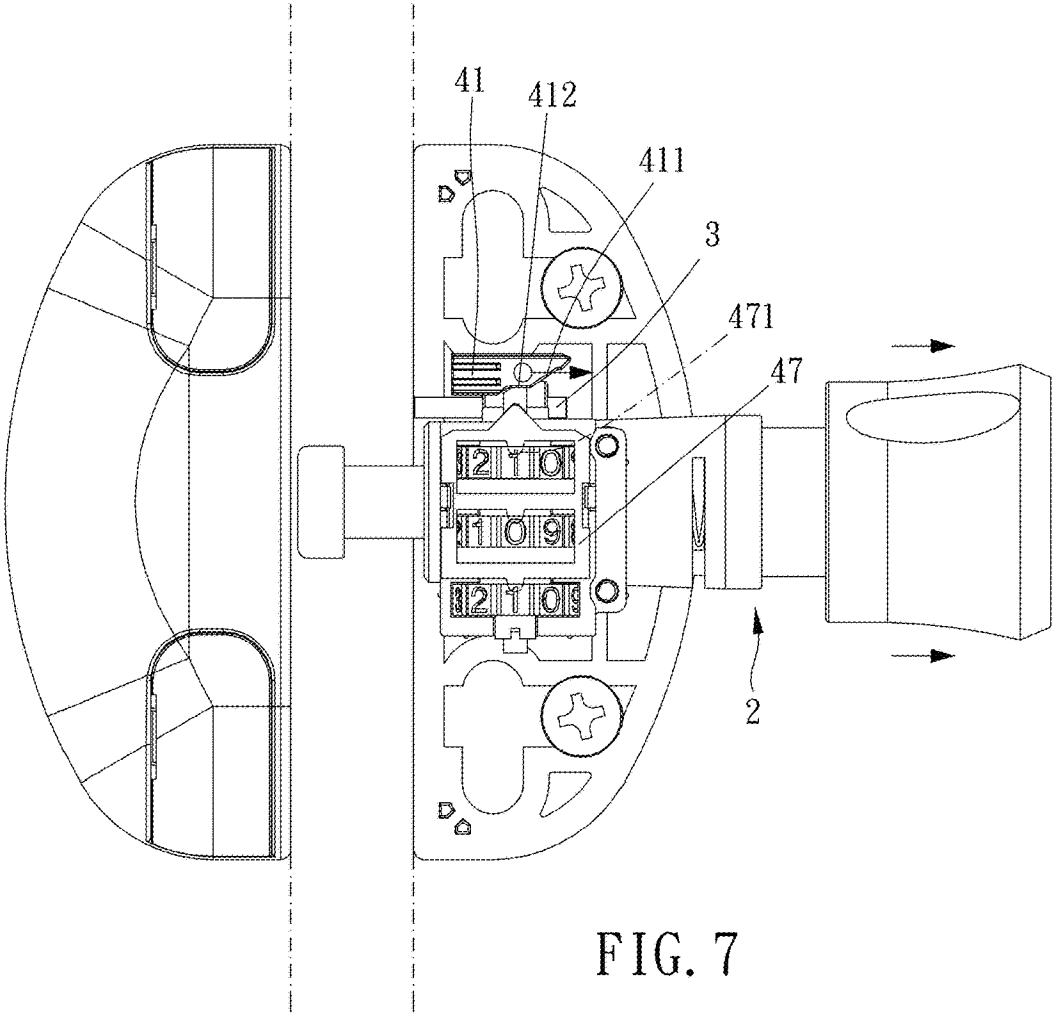
Figure 9:
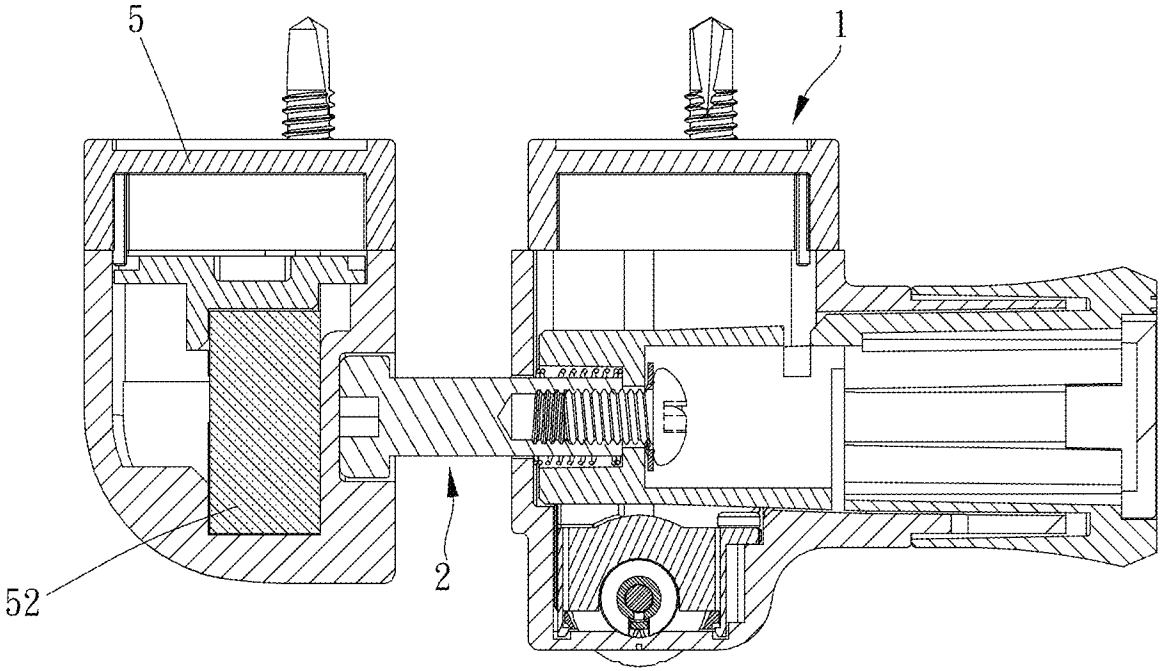
FIGS. 9 and 10 are cross-sectional views showing operation of a preferable embodiment of the present invention.
Figure 10:
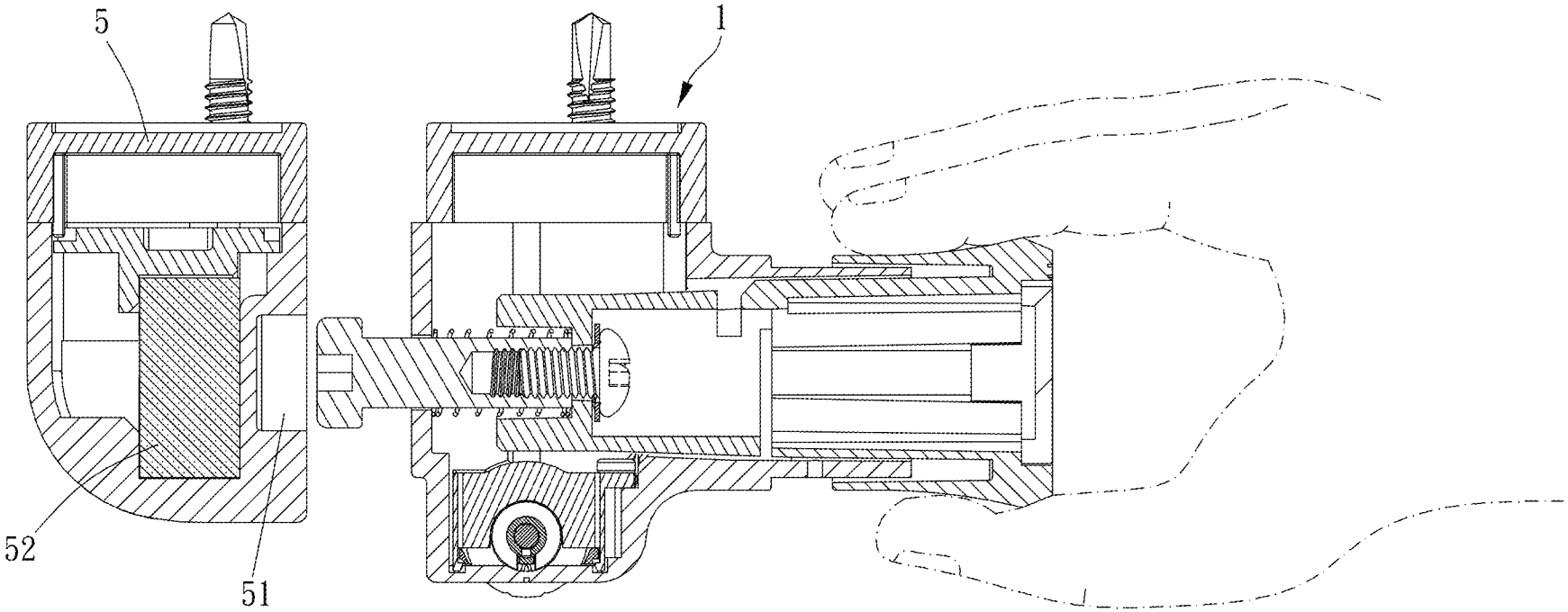

As shown in FIGS. 5 and 6, when the locking member 4 is in the locking state and the latch member 2 is located in the first position, the latch member 2 is protrusive to be configured to be inserted within a locked object, the locking member 4 and the blocking member 3 are free of blocking from each other so that the blocking member 3 is moved to the third position, the first blocking portion 21 and the second blocking portion are blocked with each other, and the latch member 2 is unmovable toward the second position so that the latch member 2 cannot disengage from the locked object (in the locking state), As shown in FIGS. 7 and 8, when the locking member 4 is in the unlocked state, the locking member 4 urges the blocking member 3 to move to the fourth position, the second blocking portion and the first blocking portion 21 are unblocked with each other and the latch member 2 is movable to the second position so that the latch member is retractable from the locked object. Whereby, the lock is provided without an additional locking member, and it can effectively lock the locked object and is easy to unlock.

The latch member 2 includes a grip 22 and a pin member 23 connected with the grip 22, and the pin member 23 is configured to be inserted within the locked object. For example, the housing 1 may be mounted to a door body, the locked object is a door frame or another door body, and a first elastic member 24 is abutted against the latch member 2 to bias the latch member 2 to move toward the second position. In this embodiment, the first elastic member 24 is abutted against and between the housing 1 and the latch member 2. Preferably, the lock further includes a limitation member 5, the limitation member 5 is configured to be included in the locked object, and the limitation member 5 includes an insertion hole 51. When the latch member 2 is in the first position, the latch member 2 is inserted within the insertion hole 51 so as to lock the door body and the locked object, wherein one of the latch member 2 and the limitation member 5 includes a magnetically-attractable member 52 which is relatively magnetically-attractable to the latch member so that the latch member 2 is attracted to be within the insertion hole 51. As a result, even the blocking member 3 is in the fourth position, the latch member 2 is magnetically-attracted to be within the insertion hole 51 and does not unintendedly move to the second position, and the latch member 2 can be pulled by a hand to move the latch member 2 to the second position. When the latch member 2 moves to the second position, the first elastic member 24 urges the latch member 2 to be located in the second position so as to prevent detachment of the latch member 2 due to attraction of the magnetically-attractable member 52.

Specifically, the latch member 2 is slidably mounted to the housing 1, the first blocking portion 21 includes a groove extending in a direction lateral to a direction in which the latch member 2 slides, and the second blocking portion is engageable within the groove.

In this embodiment, the locking member 4 further includes a driving member 41, and the driving member 41 is movable to be in the locking state or the unlocked state. When the driving member 41 is in the locking state, the locking member and the blocking member 3 are free of blocking from each other; and when the driving member 41 is moved to the unlocked state, the driving member 41 urges the blocking member 3 to move to the fourth position.

Specifically, the blocking member 3 is rotatably mounted to the housing 1 and rotatable to be in the third position and the fourth position, the driving member 41 is abutted against a first end of the blocking member 3 opposite to the second blocking portion, and a point where the blocking member 3 is rotatably mounted to the housing 1 is located between the second blocking portion and a point where the driving member 41 urges the blocking member 3 so that the blocking member 3 can move like a see-saw. Specifically, the driving member 41 is slidably mounted to the housing 1, the driving member 41 includes an inclined section 411 and a flat section 412 connected with the inclined section 411. When the driving member 41 moves from the locking state toward the unlocked state, the inclined section 411 urges the blocking member 3 to move away from the second blocking portion (as shown in FIG. 5) so that the inclined section 411 is slidable relative to the blocking member 3 to urges the blocking member 3 to move from the third position toward the fourth position; and when the driving member 41 moves to be in the unlocked state, the blocking member 3 moves to the fourth position and the blocking member 3 is abutted against the flat section 412 (as shown in FIG. 7) so that the driving member 41 can be retained in the unlocked state and the blocking member 3 can be retained in the fourth position. As a result, it has no need to keep pressing the driving member 41 to retain the unlocked state, and it is convenient to operate.

Preferably, the locking member 4 includes a shell member 42, at least two coded ring members 43 and a lock core 44. The shell member 42 is mounted to the housing 1, the at least two coded ring member 43 are rotatably mounted to the shell member 42, and the lock core 44 is mounted to the shell member 42 and slidable to be in a fifth position or a sixth position. The at least two coded ring member 43 block and constrain the lock core 44 to be in the fifth position so that the lock core 44 urges the blocking member 3 to the third position and the driving member 41 is in the locking state. When the at least two coded ring member 43 are rotated to be in a manner that the lock core 44 is free of blocking from the at least two coded ring members 43 (preset code combination), the lock core 44 is movable to the sixth position so that the blocking member 3 is movable toward the fourth position, in which the driving member 41 can be moved to be in the unlocked state and the blocking member 3 can be moved to be in the fourth position. Preferably, the locking member 4 further includes a second elastic member 45, and the second elastic member 45 bias the lock core 44 toward the fifth position so that the blocking member 3 has a tendency to move toward the third position.

In this embodiment, the lock core 44 includes a shaft 46 and a latching plate 47, each said coded ring member 43 includes a sleeve portion 48, and each said sleeve portion 48 includes a notch 481. The shaft 46 is disposed through each said sleeve portion 48 and slidable to be in the fifth position or the sixth position. The latching plate 47 receives the at least two coded ring members 43 and includes at least two projections 471 respectively corresponding to the at least two sleeve portions 48. The latching plate 47 is abutted against and between the shaft 46 and the blocking member 3 so that the shaft 46, the blocking member 3 and the latching plate 47 are co-movable. When the at least two coded ring members 43 are rotated to be in a manner that each said projection 471 corresponds to one said notch 481, the shaft 46 is movable to the sixth position. In this embodiment, the locking member 4 is a combination locking member; however, the locking member may be a locking member which can be unlocked via a key.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lock, including:

a housing;

a latch member, mounted to the housing and being movable between a first position and a second position relative to the housing, the latch member including a first blocking portion; a blocking member, mounted to the housing and being movable between a third position and a fourth position, including a second blocking portion, the blocking member having a tendency to move toward the third position;

a locking member, mounted to the housing and being operable to be in a locking state or an unlocked state;

wherein when the locking member is in the locking state and the latch member is located in the first position, the latch member is protrusive to be configured to be inserted within a locked object, the locking member and the blocking member are free of blocking from each other so that the blocking member is moved to the third position, the first blocking portion and the second blocking portion are blocked with each other, and the latch member is unmovable toward the second position; when the locking member is in the unlocked state, the locking member urges the blocking member to move to the fourth position, the second blocking portion and the first blocking portion are unblocked with each other and the latch member is movable to the second position so that the latch member is retractable from the locked object;

wherein the latch member includes a grip and a pin member connected with the grip, the pin member is configured to be inserted within the locked object, and a first elastic member is abutted against the latch member to bias the latch member to move toward the second position.

2. The lock of claim 1, wherein the latch member is slidably mounted to the housing, the first blocking portion includes a groove extending in a direction lateral to a direction in which the latch member slides, and the second blocking portion is engageable within the groove.

3. A lock, including:

a housing;

a latch member, mounted to the housing and being movable between a first position and a second position relative to the housing, the latch member including a first blocking portion, a blocking member, mounted to the housing and being movable between a third position and a fourth position, including a second blocking portion, the blocking member having a tendency to move toward the third position;

a locking member, mounted to the housing and being operable to be in a locking state or an unlocked state;

wherein when the locking member is in the locking state and the latch member is located in the first position, the latch member is protrusive to be configured to be inserted within a locked object, the locking member and the blocking member are free of blocking from each other so that the blocking member is moved to the third position, the first blocking portion and the second blocking portion are blocked with each other, and the latch member is unmovable toward the second position; when the locking member is in the unlocked state, the locking member urges the blocking member to move to the fourth position, the second blocking portion and the first blocking portion are unblocked with each other and the latch member is movable to the second position so that the latch member is retractable from the locked object;

wherein the locking member includes a driving member, the driving member is movable to be in the locking state or the unlocked state, when the driving member is in the locking state, the locking member and the blocking member are free of blocking from each other; and when the driving member is moved to the unlocked state, the driving member urges the blocking member to move to the fourth position.

4. The lock of claim 3, wherein the blocking member is rotatably mounted to the housing and rotatable to be in the third position or the fourth position, the driving member is abutted against a first end of the blocking member opposite to the second blocking portion, and a point where the blocking member is rotatably mounted to the housing is located between the second blocking portion and a point where the driving member urges the blocking member.

5. The lock of claim 3, wherein the driving member is slidably mounted to the housing, the driving member includes an inclined section and a flat section connected with the inclined section, when the driving member moves from the locking state toward the unlocked state, the inclined section urges the blocking member to move away from the second blocking portion so that the inclined section is slidable relative to the blocking member to urges the blocking member to move from the third position toward the fourth position, and when the driving member moves to be in the unlocked state, the blocking member moves to the fourth position and the blocking member is abutted against the flat section.

6. The lock of claim 3, wherein the locking member includes a shell member, at least two coded ring members and a lock core, the shell member is mounted to the housing, the at least two coded ring members are rotatably mounted to the shell member, the lock core is mounted to the shell member and slidable to be in a fifth position or a sixth position, the at least two coded ring members block and constrain the lock core to be in the fifth position so that the lock core urges the blocking member to the third position and the driving member is in the locking state, and when the at least two coded ring members are rotated to be in a manner that the lock core is free of blocking from the at least two coded ring members, the lock core is movable to the sixth position so that the blocking member is movable toward the fourth position.

7. The lock of claim 6, wherein the locking member further includes a second elastic member, and the second elastic member bias the lock core toward the fifth position so that the blocking member has a tendency to move toward the third position.

8. The lock of claim 7, wherein the lock core includes a shaft and a latching plate, each said coded ring member includes a sleeve portion, each said sleeve portion includes a notch, the shaft is disposed through each said sleeve portion and slidable to be in the fifth position or the sixth position, the latching plate receives the at least two coded ring members and includes at least two projections respectively corresponding to the at least two sleeve portion, the latching plate is abutted against and between the shaft and the blocking member so that the shaft, the blocking member and the latching plate are co-movable, and when the at least two coded ring members are rotated to be in a manner that each said projection corresponds to one said notch, the shaft is movable to the sixth position.

9. The lock of claim 1, further including a limitation member, wherein the limitation member is configured to be included in the locked object, the limitation member includes an insertion hole, when the latch member is in the first position, the latch member is inserted within the insertion hole, and one of the latch member and the limitation member includes a magnetically-attractable member which is relatively magnetically-attractable to the latch member so that the latch member is attracted to be within the insertion hole.

* * * * *